United States Patent [19]

Stroucken

[11] Patent Number: 4,930,412

[45] Date of Patent: Jun. 5, 1990

[54] CENTRIFUGAL SPARATOR

[75] Inventor: Klaus Stroucken, Rönninge, Sweden

[73] Assignee: Alfa-Laval Separation AB, Tumba, Sweden

[21] Appl. No.: 250,176

[22] Filed: Sep. 28, 1988

[30] Foreign Application Priority Data

Oct. 13, 1987 [SE] Sweden ..... 87039657

[51] Int. Cl.[5] ..... B04B 1/08

[52] U.S. Cl. ..... 494/70; 494/64; 494/68; 494/76

[58] Field of Search ..... 494/40, 38, 56, 64, 494/67–73, 76, 77

[56] References Cited

U.S. PATENT DOCUMENTS

| | | | |
|---|---|---|---|
| 797,297 | 8/1905 | Ljungstrom | 494/70 |
| 1,721,230 | 7/1929 | Molbach | 494/70 |
| 2,087,630 | 7/1937 | Schelbeck | 494/64 |

FOREIGN PATENT DOCUMENTS

| | | | |
|---|---|---|---|
| 48615 | 9/1889 | Fed. Rep. of Germany . | |
| 115438 | 11/1900 | Fed. Rep. of Germany | 494/71 |
| 342445 | 10/1921 | Fed. Rep. of Germany | 494/67 |
| 19666 | 7/1905 | Sweden | 494/70 |
| 21885 | 2/1907 | Sweden | 494/70 |
| 707606 | 1/1980 | U.S.S.R. . | |
| 434263 | 8/1935 | United Kingdom | 494/67 |
| 580384 | 9/1946 | United Kingdom | 494/64 |

OTHER PUBLICATIONS

*From Gustav de Laval's Cream Skimmer to Industrial Processing,* Magnusson, Alfa-Laval AB, 1986, Chapter 8.

PCT WO 86/04270, Kind, Centrifugal Separator, Jul. 31, 1986.

*Primary Examiner*—Harvey G. Hornsby
*Assistant Examiner*—Stephen F. Gerrity
*Attorney, Agent, or Firm*—Davis Hoxie Faithfull & Hapgood

[57] ABSTRACT

In a centrifuge rotor for separation of two liquids having different densities from a mixture thereof a stack of conical separation discs (21) is arranged in the separation chamber (13) with the base portions of the separation discs turned towards one end and with the apex portions of the separation discs turned towards the other end of the separation chamber. According to the invention the separation chamber (13) has an inlet for mixture situated at the end, towards which the separation discs turn their apex portions, and an outlet for separated relatively heavy liquid situated at the opposite end. The inlet for liquid mixture as well as both outlets for the separated liquids are situated at the same axial end wall of the centrifuge rotor.

10 Claims, 2 Drawing Sheets

CENTRIFUGAL SPARATOR

FIELD OF THE INVENTION

The present invention relates to a centrifugal separator for the separation of two liquids having different densities from a mixture thereof. The centrifugal separator is of the kind comprising a rotor body having a separation chamber, having a stack of conical separation discs arranged coaxially with the rotor in the separation chamber with their base portions facing one end and their apex portions facing the other end of the separation chamber, a central inlet chamber, inlet passages connecting the inlet chamber with the separation chamber at the end of the latter towards which the apices of the separation discs face and separate outlets for relatively light and relatively heavy separated liquid, which two outlets are situated at one and the same axial outlet end of the rotor, said inlet passages having substantially the same inclination relative to the rotor axis as the separation discs. A centrifugal separator of this kind is shown e.g. in the Swedish Patent No. 19666 from the year 1904. It is unknown whether a centrifugal separator of this kind has been produced and used in practice.

The term "conical separation discs" refers to the type of completely conical or frusto-conical plates employed in centrifugal separators since von Bechtolsheim's invention, disclosed in German Patent No. 48615 of 19 Sept. 1889. The term "conical", used to describe these discs, is employed in its common geometric sense to mean the surface generated by the whole or part of the hypoteneuse of a right triangle when the triangle is rotated about one leg. The "apex" end of the conical surface is the narrow end and the "base" end is the broad end.

BACKGROUND OF THE INVENTION

From the turn of the century and onwards centrifugal separators have normally not been designed in the manner described. Instead, the inlet of the separation chamber has been situated at the end of the separation chamber, towards which the base portions of the separation discs face. A conventional centrifugal separator of this kind is shown e.g. in U.S Pat. No. 3,986,663. However, even centrifugal separators of the latter kind have a rotor with outlets for the two separated liquids situated at one and the same axial end of the rotor. This has several advantages. Among other things the outlet members of the rotor, which may have to be adjusted, are more easily accesible. Furthermore, use of stationary so called paring members for the discharge of the separated liquids from the rotor is facilitated.

A principle advantage of a centrifugal separator of the first kind, into which a mixture is introduced in the separation chamber at the end, towards which the apices of the separation discs face, is that a pre-separation, which takes place in the inlet passages before the mixture enters the separation chamber, can be taken advantage of to the maximum. Thus, part of the relatively heavy liquid component and possibly solids in the liquid mixture, may be separated, even as the mixture, is on its way through said inlet passages between the central inlet chamber and the inlet of the separation chamber. Relatively heavy component of the supplied mixture, separated in the inlet passages, may slide along the outer walls of the inlet passages directly out into the outermost part of the separation chamber radially outside the separation discs without being disturbed by or disturbing the rest of the mixture when this flows into the separation chamber.

In a conventional centrifugal separator, in which the liquid mixture is introduced through inlet passages at the end of the separation chamber, towards which the base portions of the separation discs face, (see e.g. U.S. Pat. No. 3,986,663), a relatively heavy component of the mixture, separated in the inlet passages, is forced to cross the flow of the rest of the mixture as the latter enters the separation chamber. This is a consequence of the fact that the inlet passages have an inclination relative to the rotor axis just about the same as that of the conical separation discs. Thereby, the result of the pre-separation in the inlet passages is spoiled wholly or partly. This undesired effect of the cross flow will be greatest when the entire mixture is introduced into the separation chamber at the outer edge of the separation disc situated closest to the inlet passages.

The object of the present invention is to provide a centrifugal separator, whose rotor in the first place has the arrangement, known at least since 1904, for introducing a liquid mixture into the separation chamber and, in the second place, has both the outlets for the separated liquids available at one and the same end of the rotor. The centrifugal separator has an improved design enabling more effective separation of two liquids having different densities than a centrifugal separator of the kind shown in the above mentioned Swedish Patent No. 19666.

SUMMARY OF THE INVENTION

In accordance with the invention this object is achieved by means of a centrifugal separator of the initially defined kind, characterized in that at least one outlet channel extends from a radially outer part of the separation chamber towards the rotor center at the end of the separation chamber towards which the base portions of the separation discs face and that this outlet channel communicates with the rotor outlet for separated heavy liquid at said outlet end of the rotor.

In a centrifugal separator according to the invention pre-separation in said inlet passages may be taken advantage of to its maximum extent as the relatively heavy liquid component of the mixture is given a long axial flow path in the separation chamber. Thereby relatively heavy liquid may be separated effectively from relatively light liquid and simultanteously freed from solids present in the mixture, which are heavier than the relatively heavy liquid. Furthermore, both the separated liquids are available for discharge from the rotor at one and the same end thereof.

Within the scope of the invention it is possible to locate both the rotor outlets for the separated liquids at either of the rotor ends, the rotor being connected with a driving shaft at its opposite end. However, in a preferred embodiment of the invention the two rotor outlets are situated at the end of the rotor, towards which the apex portions of the separation discs face, outlet means having at least one through channel being arranged to conduct relatively heavy separated liquid from said outlet channel axially through the separation chamber to the rotor outlet for the separated heavy liquid. Thereby, the rotor can be connected with the driving shaft so that its point of gravity will be located as close as possible to the drive and its bearings, viewed axially.

BRIEF DESCRIPTION OF THE DRAWINGS

The invention will be described more fully with reference to the accompanying drawings in which.

DETAILED DESCRIPTION OF THE INVENTION

Figure 1:
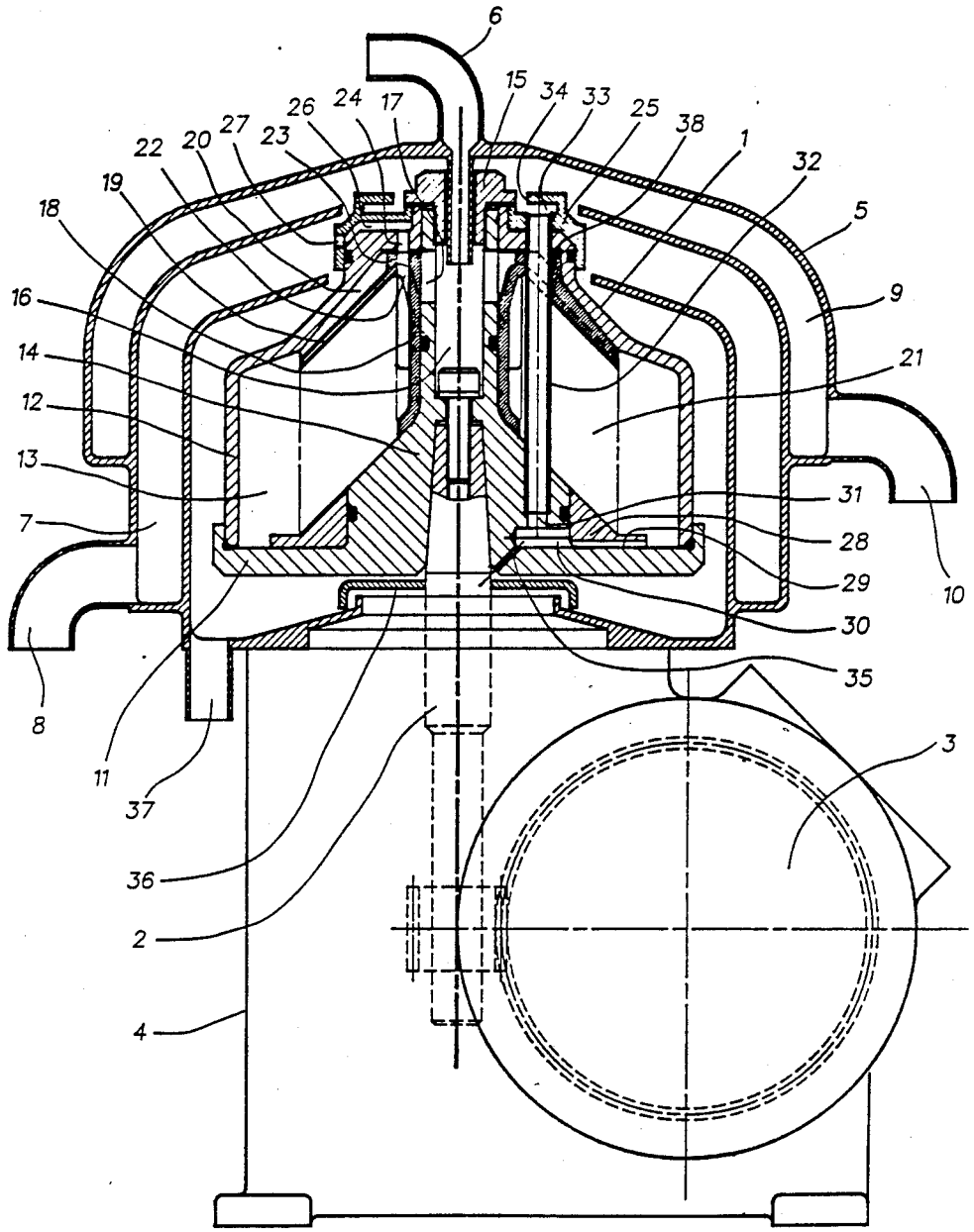
FIG. 1. is a schematic view partly in vertical section of a centrifugal separator according to a preferred embodiment of the invention.

FIG. 1 shows a centrifugal separator having a rotor 1, a vertical drive shaft 2 supporting the rotor, a driving device 3 in engagement with the drive shaft, a lower housing 4 for the driving device 3 and an upper housing 5 for the rotor.

The upper housing 5 forms an inlet tube 6 for a mixture of two liquids having different densities and particles suspended therein. Further, the housing 5 forms a receiving chamber 7 having an outlet 8 for separated relatively light liquid and a receiving chamber 9 having an outlet 10 for a separated relatively heavy liquid.

The rotor comprises two rotor parts 11 and 12, which are kept axially pressed against each other and which surround a separation chamber 13. The rotor part 11, which forms the bottom of the separation chamber 13 and is connected with the driving shaft 2, has a central column 14, the upper part of which holds the rotor part 12 by means of an annular locking member 15. The rotor part 12 forms a substantially cylindrical surrounding wall and a substantially conical upper end wall of the rotor.

A narrow end portion of the inlet tube 6 extends axially through the locking member 15 into a central inlet chamber 16 formed in a tubular upper portion of the central column 14. This tubular portion of the column 14 has several openings 17 in its surrounding wall. The locking member 15 forms an upper annular end wall in the inlet chamber 16.

Around the central column 14 there is arranged a partition member having a sleeve formed part 18 and a conical part 19. The sleeve formed part 18 surrounds the column 14 below said openings 17. An annular gasket seals between the sleeve formed part 18 and the column 14. The conical part 19 abuts against said upper end wall of the rotor. Radial recesses in the conical part 19 form between this and the rotor end wall several passages 20, which connect the openings 17 with the separation chamber 13.

Between the conical part 19 and the lower rotor part 11 there is arranged in the separation chamber 13 coaxially with the rotor axis a set of frusto-conical separation discs 21. The outer edges of the separation discs 21 are situated substantially at the same radial level as the outer edge of the previously mentioned conical part 19. The inner edges of the separation discs 21 are situated at some radial distance outside the sleeve formed part 18, so that a central space is formed in the separation chamber 13 radially inside of the separation discs 21. This space is divided in parallel axial channels by radially and axially extending wings supported by the sleeve formed part 18.

The conical part 19 has a number of, for instance three, axial throug-channels 22 and supports on its upper side an equal number of tubular members 23, the interior of which communicates with the channels 22. Also the rotor part 12 has an equal number of axial through-channels 24, which are situated such that they communicate through the tubular members 23 with the respective channels 22. An annular gasket is arranged to seal between the tubular members 23 and the rotor part 12 around the channels communicating with each other.

On the top of the rotor part 12 there is arranged an annular member 25, which together with the rotor part 12 forms a chamber 26, in which the channels 24 through the rotor part 12 are opening. The chamber 26 has one or several peripheral outlets 27.

In the lower part of the separation chamber 13 there is placed an annular member 28, which axially inwards and axially down wards seals against the rotor part 11 and extends radially outwards into the separation chamber 13 a distance longer than the separation discs 21. On its under side the annular member 28 has a number or radial grooves, which form channels 29 extending between the separation chamber 13 and an equal number of central radial channels 30 in the rotor part 11. The radial channels 30 communicate with a number of axial channels 31, in which axial tubes 32 are inserted.

The tubes 32 extend through aligned holes in the separation discs 21 and further through holes in the previously mentioned conical part 19, holes in the rotor part 12 and holes in the annular member 25. Sealing gaskets are arranged around said holes and around the tubes 32 between the rotor part 12 and the conical part 9 and the annular member 25, respectively.

The interior of the tubes 32, which through the channels 29–31 communicates with the separation chamber 13, opens into a radially inwards open groove 33 in the annular member 25. The upper edge of the groove 33 forms an overflow outlet 34 therefrom.

From the radially innermost part of each channel 30 a draining channel 35 extends through the rotor part 11 to the outside of the rotor. A shielding member 36 is connected with the driving shaft 2 and is arranged to prevent liquid leaving the rotor through the draining channels 35 from flowing down into the housing 4 of the driving device. The rotor housing 5 has a separate outlet 37 for such liquid.

Figure 2:
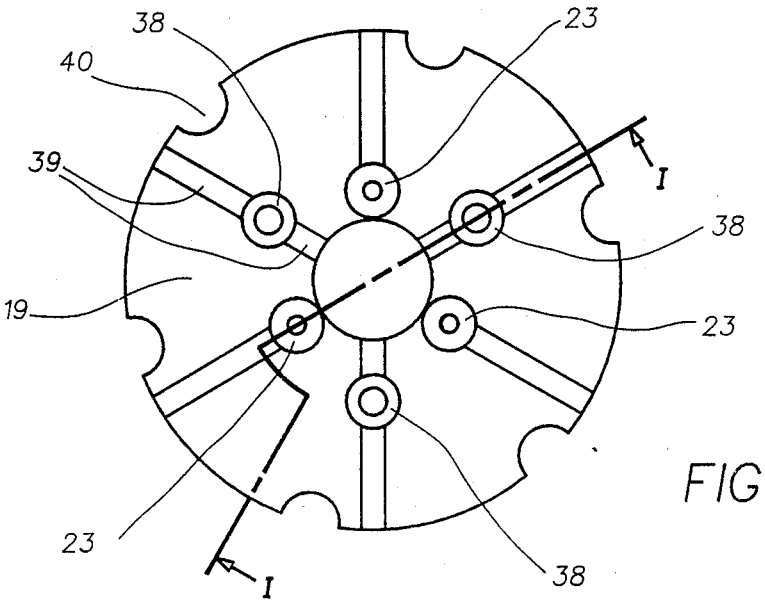
FIG. 2, is a plan view of an element of the centrifugal separator of FIG. 1.

FIG. 2 shows from above the partition member that comprises the conical part 19. Apart from the three previously mentioned tubular members 23 three futher tubular members 38 are shown, through the openings of which the tubes 32 (FIG. 1) are intended to be inserted. As can be best seen from FIG. 2 the tubular members 38 are situated at a greater radius than the tubular members 23. Radially and axially extending ridges 39 on the upper side of the conical part 19 form between themselves the previously mentioned recesses which together with the rotor part 12 form the passages 20 in FIG. 1.

Around its circumference the conical part 19 has a number of recesses 40, the function of which is to be described later. Corresponding recesses axially aligned with the recesses 40 are present in all of the separation disc 21 in the separation chamber 13.

Figure 3:
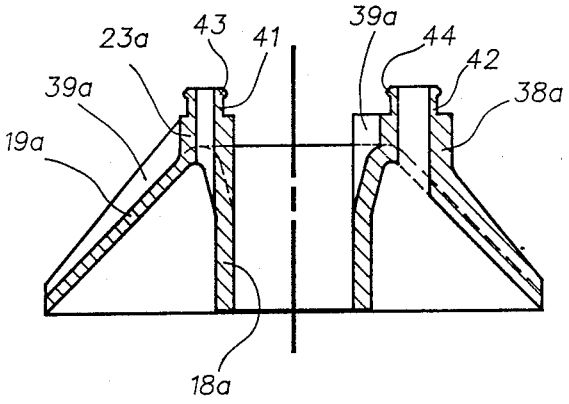
FIG. 3. is a view in vertical section of a somewhat modified element of the centrifugal separator shown in FIG. 1.

FIG. 3 shows a section through a somewhat modified partition member comprising a conical part **19*a*, a sleeve formed part 18*a* and tubular members 23*a* and 38*a***. The partition member shown in FIG. 3 is intended to be made entirely of plastic, and as can be seen the tubular members 23*a* and 38*a* have been shaped in a way enabling a firm connection between these and the rotor part 12. Sleeve formed extensions 41 and 42 having small external annular end flanges 43 and 44, respectively, are dimensioned such that they are resilient when they are inserted in the holes in the rotor part 12 intended therefor.

Figure 4:
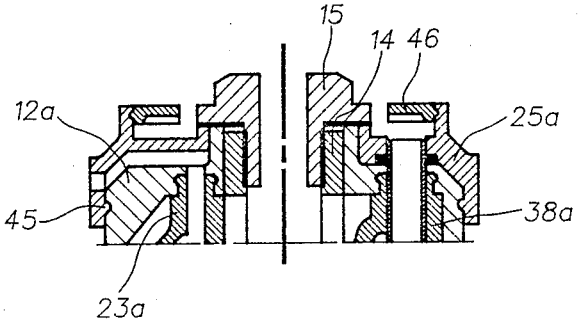
FIG. 4. shows a modified embodiment of an element of the separator shown in FIG. 1.

FIG. 4 shows the upper part of a rotor according to FIG. 1, comprising a partition member according to FIG. 3. The tubular members 23*a* and 38*a* are inserted into through-channels in the rotor part 12*a*. The walls of these channels have annular grooves for receiving the annular end flanges 43 and 44 (FIG. 3). The partition member is thus connected with the rotor part 12*a* by means of a so called snap-lock connection.

A further so called snap-lock connection is present between the rotor part 12*a* and the annular member 25*a*. The latter has an internal annular flange 45 which engages in an external groove in the rotor part 12*a*.

Instead of a fixed end wall the annular member 25*a* has a removable and thus exchangeable annular end wall 46, the inner edge of which forms an overflow outlet corresponding to the overflow outlet 34 in FIG. 1. Even the end wall 46 is kept in place at the annular member 25*a* by means of a so called snap-lock connection.

The centrifugal separator in FIG. 1 is intended to operate in the following manner after the rotor 1 has been put in rotation by means of the driving device 3.

Through the tube 6 a mixture of two liquids having different densities and solids suspended therein are introduced into the central inlet chamber 16. The mixture flows through the openings 17 and the passages 20 to the separation chamber 13. Mainly through the recesses 40 in the conical part 19 and corresponding recesses in the separation discs 21 the mixture is distributed between the separation discs.

Even in the passages 20 a pre-separation of the three components forming the supplied mixture takes place. A large part of the suspended solids and part of the heavier of the liquids move along the rotor part 12 out of the surrounding wall of the separation chamber 13 without interfering with the continued flow of the liquid mixture into the separation chamber. The liquid mixture together with possibly remaining solids is then distributed between the separation discs 21. Between the separation discs the two liquids of different densities are separated, the lightest liquid flowing radially inwards and being conducted through the channels 22 and 24 to the chamber 26, whereas the heaviest liquid flows radially outwards. Outside the separation discs 21 the latter liquid flows axially downwards in the separation chamber and out thereof through the channels 29. It is conducted further through the channels 30 and 31 and by the tube 32 to the annular groove 33.

While the separated heavy liquid leaves over the overflow outlet 34 the separated light liquid leaves through the outlet 27 of the chamber 26. The outlet 27 is so large that the chamber 26 during normal operation is only partly filled. This means that the tubular members 23 and the radially outer limiting walls of the channels 22 and 24 form overflow outlets from the separation chamber 13 for the separated light liquid. The position of the interface layer formed between the two separated liquids in the separation chamber during operation is determined by the position of the two overflow outlets of the separation chamber. The position of the interface layer may be changed by exchange of the annular member 25 for one, whose overflow outlet 34 is situated at a different radial level. As an alternative, of course, an exchangeable so called gravity disc may be arranged in the chamber 26 or the groove 33.

If desired, conventional distribution channels extending axially through the separation discs 21 and the conical part 19 may be situated at any desired distance from the rotor axis.

Upon need the annular member 28 at the bottom of the separation chamber may be exchanged for one having a larger or smaller radial extension.

To remove separated solids from the separation chamber the locking member 15 has to be removed and the rotor parts 11 and 12 have to be separated.

Since the channels 22 and 24 will serve during operation as overflow outlets of the separation chamber 13, a free liquid surface will be formed in the separation chamber radially outside the sleeve formed part 18 around the central column 14. Possible liquid leakage past the gasket between the column 14 and the sleeve formed part 18 therefore will be directed away from the inlet chamber 16 to the separation chamber 13. Since the lower portion of the sleeve formed part 18 is situated at a substantial axial distance from the overflow outlet 24 for separated light liquid, any possible leakage will be of such small magnitude, that it will not influence the separation in the rotor.

In a preferred embodiment of the invention the elements 11, 12 and 32 are made of metal, whereas the elements 18, 19, 25 and 28 are made of plastic. Thereby, instead of separate sealing members such as gaskets placed between the tubular members 23, 38 and the rotor part 12, the tubular members 23 and 38 made of plastic will accomplish sealing by themselves. Preferably this is achieved by shaping the members in question to provide a firm connection, for instance a so called snap-lock connection, between these and the rotor part 12 (FIG. 4). Thus one avoids breaking the important sealing between the tubular members 23, 38 and the rotar part 12 each time the rotor is to be disassembled; in other words the sealing function will be more safe and will not be jeopardized by wear or damage. Furthermore, the disassembling and mounting of the rotor is facilitated by the fact that the latter will consist of a smaller number of parts. Also the uppermost annular member 25 may be formed so that a firm connection may be obtained between this and the rotor part 12 (FIG. 4).

The tubes 32 preferably are fixed to the rotar part 11, so that they can keep the separation discs 21 in unchanges positions when the rotor part 12 is removed. The tubes 32 thus serve as guiding members for the separation discs 21 and prevent them from being turned relative to each other during rotation of the rotor.

I claim:

1. Centrifugal separator for the separation of two liquids having different densities from a mixture thereof, comprising a rotor body having a separation chamber having two ends and an axis of rotation, said separation chamber having inlet and outlet ends, a stack of conical separation discs, said discs each having a surface, an apex portion and a base portion, said discs being arranged coaxially with the rotor body in the separation chamber with their base portions facing one end, their apex portions facing the other end of the separation chamber and their sirfaces inclined from the base portion to the apex portion at an angle to the axis of the rotor body, said rotor body having a central inlet chamber, inlet passages connecting the inlet chamber with the separation chamber at the end of the separation chamber towards which the apex portions of the separation discs face, and separate outlets for separated relatively light and relative heavy liquid fractions, which outlets are situated at the same axial outlet end of the rotor body, said inlet passages having substantially the same inclination relative to the rotor body axis as the surfaces of the separation discs, and at least one outlet channel extending from a radially outer part of the separation chamber towards the axis of the rotor body at the end of the separation chamber towards which the bases of the separation discs face, said outlet channel communicating with said outlet for separated heavy liquid at the outlet end of the rotor.

2. The centrifugal separator claimed in claim 1 wherein the outlet channel starts from a level in the separation chamber radially outside the base portions of the conical separation discs.

3. The centrifugal separator claimed in claims 1 or 2 and further comprising a drive shaft having an end on which the rotor body is supported, the separation disc having their apex portions facing away from the drive shaft and the rotor outlets for separated liquids are separated at the end of the rotor remote from the drive shaft.

4. The centrifugal separator claimed in claim 3 wherein the rotor body at the end remote from the drive shaft has an inlet for introducing mixture to be separated in the central inlet chamber.

5. Centrifugal separator for the separation of two liquids having different densities from a mixture thereof, comprising a rotor body having a separation chamber with two ends, and an axis or rotation, said separation chamber having inlet and outlet ends, a stack of conical separation discs, said discs each having a surface, an apex portion and a base portion, said discs being arranged coaxially with the rotor body in the separation chamber with their base portions facing one end of the separation chamber, their apex portions facing the other end of the separation chamber and their surfaces inclined from the base portion to the apex portion at an angle to the axis of the rotor body, said rotor body having a central inlet chamber, inlet passages connecting the inlet chamber with the separation chamber at the end of the separation chamber toward which the apex portions of the separation discs face, and separate outlets for separated relatively light and relatively heavy liquid portions, which outlets are situated at the same axial outlet end of the rotor body, said inlet passages having substantially the same inclination relative to the rotor body axis as the surfaces of the separation discs, at least one outlet channel extending from a radially outer part of the separation chamber toward the axis of the rotor body at the end of the separation chamber toward which the bases of the separation discs face, and at least one through channel for conducting relatively heavy separated liquid from said outlet channel in an axial direction through the separation chamber to the rotor outlet for separated relatively heavy liquid.

6. The centrifugal separator claimed in claim 5, wherein there are a plurality of through channels distributed around the rotor axis.

7. The centrifugal separator claimed in claim 5, wherein said through channel extends through the separation discs.

8. The centrifugal separator claimed in claim 5 and comprising a partition member for delimiting said inlet passages, said partition member being arranged between the stack of separation discs and a part of the rotor body at the end of the separation chamber towards which the apex portion of the separation discs face, said through channel extending axially through the partition member.

9. The centrifugal separator claimed in claim 8 wherein the rotor body outlets for the two separated liquids are situated at the end of the rotor towards which the apex portions of separation discs face, said partition member having a number of through holes serving as outlets for separated light liquid, there being corresponding through holes in said part of the rotor body, and said separator further comprising tubular members connecting with the partition member and with said part of the rotor body around the through holes in said partition member and said part of the rotor body, thereby providing closed outlet channels from the separation chamber for separated light liquid.

10. The centrifugal separator claimed in claim 9 wherein the tubular members are formed in one piece with one of said part of the rotor body and the partition member.

* * * * *

UNITED STATES PATENT AND TRADEMARK OFFICE

CERTIFICATE OF CORRECTION

PATENT NO. : 4,930,412

DATED : June 5, 1990

INVENTOR(S) : Klaus Stroucken

It is certified that error appears in the above-identified patent and that said Letters Patent is hereby corrected as shown below:

Col. 2, line 67, after "drive" insert --shaft--;

Col. 4, line 21, "or" should be --of--;

Col. 5, line 66, "position" should be --positions--;

Col. 6, Line 50 and 51, "unchanges" should be --unchanged--;

Signed and Sealed this

Fifth Day of November, 1991

*Attest:*

HARRY F. MANBECK, JR.

*Attesting Officer*

*Commissioner of Patents and Trademarks*